US007320332B2

(12) United States Patent
Reis

(10) Patent No.: US 7,320,332 B2
(45) Date of Patent: Jan. 22, 2008

(54) PORTABLE OUTDOOR ENCLOSURE

(75) Inventor: Mike Reis, Grand Blanc, MI (US)

(73) Assignee: Eastman Holding Company, Flushing, MI (US)

( * ) Notice: Subject to any disclaimer, the term of this patent is extended or adjusted under 35 U.S.C. 154(b) by 0 days.

(21) Appl. No.: 11/060,079

(22) Filed: Feb. 17, 2005

(65) Prior Publication Data

US 2005/0178420 A1 Aug. 18, 2005

Related U.S. Application Data

(60) Provisional application No. 60/545,742, filed on Feb. 18, 2004.

(51) Int. Cl.

| | |
|---|---|
| ***E04H 15/54*** | (2006.01) |
| ***E04H 15/62*** | (2006.01) |
| ***E04H 15/64*** | (2006.01) |
| ***E04H 15/48*** | (2006.01) |

(52) U.S. Cl. ..... 135/115; 135/118; 135/119; 135/901; 135/147

(58) Field of Classification Search ..... 135/115, 135/118, 119; 47/23.1, 20.1; 52/3; 473/504
See application file for complete search history.

(56) References Cited

U.S. PATENT DOCUMENTS

| | | | | |
|---|---|---|---|---|
| 39,721 A * | 9/1863 | Cross | 135/145 |
| 887,029 A * | 5/1908 | Burch | 135/115 |
| 1,571,295 A * | 2/1926 | Newman | 135/118 |
| 1,904,700 A * | 4/1933 | Starks | 47/20.1 |
| 2,209,504 A * | 7/1940 | Beiter | 248/530 |
| 2,455,237 A * | 11/1948 | Davis | 410/97 |
| 2,923,305 A * | 2/1960 | Cline | 52/2.23 |
| 3,328,854 A * | 7/1967 | Tombari | 16/2.1 |
| 3,570,507 A | 3/1971 | Kashuba | |
| 3,709,237 A | 1/1973 | Smith | |
| 3,810,482 A | 5/1974 | Beavers | |
| 3,941,140 A * | 3/1976 | Beavers | 135/147 |

(Continued)

FOREIGN PATENT DOCUMENTS

DE 3227686 A1 * 1/1984

(Continued)

*Primary Examiner*—David Dunn
*Assistant Examiner*—Danielle Jackson
(74) *Attorney, Agent, or Firm*—Carrier, Blackman & Associates P.C.; William D. Blackman; Joseph P. Carrier

(57) ABSTRACT

A portable ice fishing enclosure includes a flexible covering cooperatively engaged with a frame, and secured to an ice surface using a plurality of threaded anchor stakes. The frame may include a plurality of sub-frames, each of which includes a central hub and a plurality of semi-rigid poles extending radially outwardly from the central hub. The lower edge of the covering includes a skirt portion having reinforced through holes at outer edges thereof, which receive the anchor stakes therein. Ends of the skirt portions extend beyond the edges of side walls of the covering, so that the skirt portion ends may be placed in an aligned overlapping configuration. A kit is described for providing components of the enclosure, and a method of assembling the enclosure is described. The portable ice fishing enclosure is lightweight, easily assembled and disassembled, and constructed to withstand, and provide protection from, the harsh winter environment.

10 Claims, 13 Drawing Sheets

U.S. PATENT DOCUMENTS

| | | | | | |
|---|---|---|---|---|---|
| 4,067,346 | A | | 1/1978 | Husted | |
| 4,263,925 | A | | 4/1981 | Arganbright | |
| D266,156 | S | | 9/1982 | Ebner et al. | |
| 4,414,993 | A | * | 11/1983 | Gillis | 135/127 |
| 4,631,877 | A | | 12/1986 | Molodecki | |
| 4,777,071 | A | * | 10/1988 | Liu | 428/120 |
| 4,819,680 | A | * | 4/1989 | Beavers | 135/125 |
| 4,926,893 | A | | 5/1990 | Klopfenstein et al. | |
| 4,938,243 | A | | 7/1990 | Foster | |
| 5,341,588 | A | | 8/1994 | Lizotte | |
| D363,755 | S | | 10/1995 | Diederich | |
| 5,564,232 | A | * | 10/1996 | Callaway | 5/4 |
| 5,628,338 | A | | 5/1997 | Stumbo | |
| 5,711,336 | A | * | 1/1998 | Nirmel | 135/87 |
| 5,749,387 | A | | 5/1998 | Thompson | |
| D432,620 | S | | 10/2000 | Rozkowski | |
| 6,155,279 | A | | 12/2000 | Humphrey | |
| 6,681,786 | B2 | * | 1/2004 | Ju | 135/120.3 |
| 2003/0140573 | A1 | | 7/2003 | Marcinkowski et al. | |

FOREIGN PATENT DOCUMENTS

| | | | | |
|---|---|---|---|---|
| DE | 2972276 | U1 | * | 5/1998 |
| EP | 0787871 | B1 | * | 8/1997 |
| JP | 06-200563 | A | * | 7/1994 |
| JP | 2004-60850 | A | * | 2/2004 |
| WO | WO-93-12312 | A1 | * | 6/1993 |

* cited by examiner

PORTABLE OUTDOOR ENCLOSURE

CROSS-REFERENCE TO RELATED APPLICATIONS

The present application claims priority under 35 USC 119 from U.S. provisional patent application No. 60/545,742, filed Feb. 18, 2004, the disclosure of which is hereby incorporated by reference.

BACKGROUND OF THE INVENTION

1. Field of the Invention

The present invention relates generally to portable structures for use in outdoor sporting activities. More specifically, the present invention relates to a portable enclosure designed and adapted for use in ice fishing, to a method of assembling an outdoor enclosure, and to a kit including a plurality of components, capable of being assembled into an enclosure at an ice fishing site, which is usable to shield the occupants from wind and to ameliorate the harshness of other elements of weather.

2. Description of the Background Art

A wide variety of portable outdoor enclosures are used in an equally wide variety of outdoor sporting activities. Such enclosures range from lightweight hiking tents to large, heavy-duty lodge tents to hunting blinds to ice fishing shanties. Each type of enclosure has evolved to meet the specific needs and requirements of the particular sporting activity.

Because of the harsh conditions in which ice fishing takes place, shelters have long been used by ice fishermen. However, early structures were large, unwieldy wooden framed structures, that were towed out on the ice as an intact body. Although sturdy and somewhat weatherproof, these structures were not easily moved from place to place on a frozen body of water. Further, such structures could not be easily dismantled and moved to other fishing lakes. In keeping with the advent of modern tent technology, ice fishing enclosures now often employ technologies that provide collapsible, lightweight, and portable structures and that provide good protection from the elements.

The background art discloses many different outdoor enclosures of various sizes, shapes, and methods of construction. A primary goal in each of the designs for outdoor enclosures is to offer an effective shelter to protect the occupants from the elements of weather. Below, some examples of known approaches for assembling and fabricating sporting enclosures are described.

Collapsible, foldable, and easily disassembled frame structures are known. Examples of such structures are disclosed in US patents to Beavers (U.S. Pat. No. 3,810,482), Foster (U.S. Pat. No. 4,938,243), and Stumbo (U.S. Pat. No. 5,628,338). Each of these patents show collapsible frames used to support a flexible covering for use as tents, blinds, or other shelters. Beavers and Stumbo each show frames which include support poles extending from a central hub, and Stumbo discloses a frame structure in which includes several sub-frames, each of which supports a portion of a flexible covering.

Many flexible coverings used in known collapsible enclosures are supported by the frame structures to provide the outer shell of the enclosure, and are commonly made of fabric. The flexible coverings normally include at least one door opening and one or more window openings. Window openings may be vacant, or alternatively, may be covered with transparent sheeting, screen, a closeable flap, or combinations thereof. Examples of such coverings are disclosed in US patents to Smith (U.S. Pat. No. 3,709,237) and to Husted (U.S. Pat. No. 4,067,346), which each disclose respective fabric extensions at a lower edge of a covering, for use in securing the covering to the ground.

A variety of approaches have been used in the prior art to stabilize a collapsible enclosure in a desired location, in all types of weather environments. A common strategy is to stake the enclosure to the ground, either by securing a lead line between a buried stake and the enclosure, or by staking the flexible covering directly to the ground. A variety of tent stakes are known, for implantation in a variety of soil types. U.S. Pat. No. D 363,755 to Diederich depicts a tent stake including a threaded shaft.

Of the group of sporting enclosures, ice fishing tents provide features which address the particular requirements of this sport, which is performed in an extreme winter environment. Such enclosures must be able to accommodate high winds associated with broad open expanses of ice, and must protect the sportsperson from the environment. Such enclosures must also be portable, and should be capable of being easily assembled in very cold conditions. They must also provide access to the ice surface from the interior of the structure, while providing environmental protection. A variety of ice fishing tents are known, and examples thereof are found in US patents to Kashuba (U.S. Pat. No. 3,570,507), Klopfstein et al. (U.S. Pat. No. 4,926,893), and Thompson (U.S. Pat. No. 5,749,387).

Although the known sporting enclosures and ice fishing shanties are useful for their respective intended purposes, a further need still exists in the art for an improved ice fishing enclosure for use in all normally experienced unfavorable elements of winter weather. In particular, there is a need for an improved ice-fishing enclosure that can be effectively secured to the surface of the ice with a minimum number of attachments, for ease of assembling the enclosure in winter conditions.

SUMMARY OF THE INVENTION

The present invention provides a portable outdoor structure adapted for use in the field of ice fishing. A structure according to a selected embodiment of the invention is quickly and easily assembled and disassembled, provides protection from the harsh winter environment, and is sized and shaped to accommodate the space requirements of the sport of ice fishing.

Accordingly, in a first embodiment of the present invention, the inventive portable outdoor structure includes a durable, lightweight flexible covering or shell cooperatively mounted on an easily disassembled, lightweight frame structure to provide a floorless covered enclosure. The shell includes a skirt portion on each sidewall, in which the skirt portion extends out substantially parallel to a supportive substrate in an assembled configuration of the structure. The ends of the skirt portion extend out beyond the sidewall to which it is attached, on both sides of the sidewall. Adjacent skirt portion ends may be placed in an overlapping stacked configuration to align through holes formed therein, and to provide a strong reinforced spot for staking the housing to the ice surface or similar substrate.

The inventive structure also includes a plurality of anchor stakes adapted for use in securing the shell of the structure to an ice surface.

The flexible shell forms the plurality of walls and the roof of the enclosure, and is open at the bottom thereof. This feature is advantageous to the sport of ice fishing, because one or more holes can be formed in the ice within the enclosure, with no limitation on the placement thereof. Further, some prior art enclosures, which include at least a partial floor, may be subject to high rates of wear, due to the abrasive quality of rough ice. Thus, formation of the enclosure without a floor prolongs the useable life of the enclosure, since floor wear is not an issue.

The lower edge of each sidewall of the shell is provided with a skirt portion extending therefrom. The skirt portion extends along substantially the entire lower edge of the covering, and is wider than the sidewall, such that the respective ends of the skirt portion extend beyond the sidewall on either side thereof. Each skirt end is provided with a rigid plastic or metal grommet. Thus, when in use, the skirt ends of adjacent sidewalls overlap one another in such a manner that the grommets overlie each other in stacked vertical alignment. The grommets are provided in the skirt ends for strength and reinforcement in staking the enclosure to the ice surface. Further, snow, rocks or weighted materials can be layered on the upper side of the skirt portion, to maintain the lower edge of the tent sidewalls adjacent the ice surface. This is especially helpful in windy conditions.

If desired, openings can be formed in the shell to provide doors, windows, and/or vents. For example, one or more flexible plastic windows may be provided in the walls of the enclosure, to admit light therein. These windows may also include flap closures. A zippered door is disposed on one of the walls to permit ingress and egress. A vent may be provided in the ceiling of the shell, to provide ventilation and to reduce or prevent moisture condensation within the enclosure.

The flexible shell is supported from within by a frame apparatus, which includes a plurality of expandable sub-frames. A sub-frame is provided for the ceiling and each wall, and each sub-frame comprises a single central hub which supports a plurality of radially extending poles. The respective distal end portions of the poles are releasably attached to the outer shell, which may be accomplished by placing the pole ends into sewn-in pockets provided for that purpose on the interior of the shell.

Optionally, the ceiling and at least one wall of the shell may be provided with a respective tensioning strap, which is adjustable to place tension on the relevant fabric panel, in order to better withstand wind.

Inventive anchor stakes are also provided as supports for the enclosure, and these stakes allow the skirt portion of the covering to be easily and securely fixed to an ice sheet, the ground, or other supportive substrate without pounding, drilling, or excessive exertion. The inventive stakes include a threaded lower end having a spiral tip thereon similar to a corkscrew, and an upper end formed into a handle. The stakes are used at the corners of the portable enclosure, passing through the skirt portions of the covering, to hold the portable enclosure in a desired location.

A second embodiment of the invention provides a generally dome-shaped housing structure, which also includes skirt portions having stackable end portions similar to those provided in the first embodiment. The housing structure in the second embodiment is supportable by a segmented pole frame structure, which may be adapted to be placed either inside or outside of the housing, and which can be attached to the housing using either fabric or elastic loops.

The present invention also encompasses a kit for use in constructing a portable ice fishing enclosure. The kit includes a plurality of the described sub-frames, along with the shell, made of thin flexible material that fits over the frame, and which tolerates and repels the elements of weather encountered outdoors in the winter. The kit also includes a plurality of anchor stakes for attaching the enclosure to a substrate, and a carrying bag for ease of storage and transportation. The anchor stakes are threaded at the ends thereof, are adapted to be screwed into a supportive substrate, and are especially adapted for screwing into a thick ice sheet.

The present invention also encompasses a method of assembling the disclosed portable outdoor enclosure.

For a more complete understanding of the present invention, the reader is referred to the following detailed description section, which should be read in conjunction with the accompanying drawings. Throughout the following detailed description and in the drawings, like numbers refer to like parts.

The present invention is not limited to its application to the details of construction and to the dispositions of the components set forth in the following description or illustrated in the drawings. The present invention is capable of other embodiments and of being practiced and carried out in various ways. In addition, it is to be understood that the phraseology and terminology employed herein are for the purposes of illustration and example, and should not be regarded as limiting.

As such, those skilled in the art will appreciate that the concept upon which this disclosure is based, may readily be utilized as a basis for the designing of other structures, methods and systems for carrying out the several purposes of the present invention. It is important, therefore, that the claims be regarded as including such equivalent constructions.

DETAILED DESCRIPTION

First Embodiment—Overview

Figure 1:
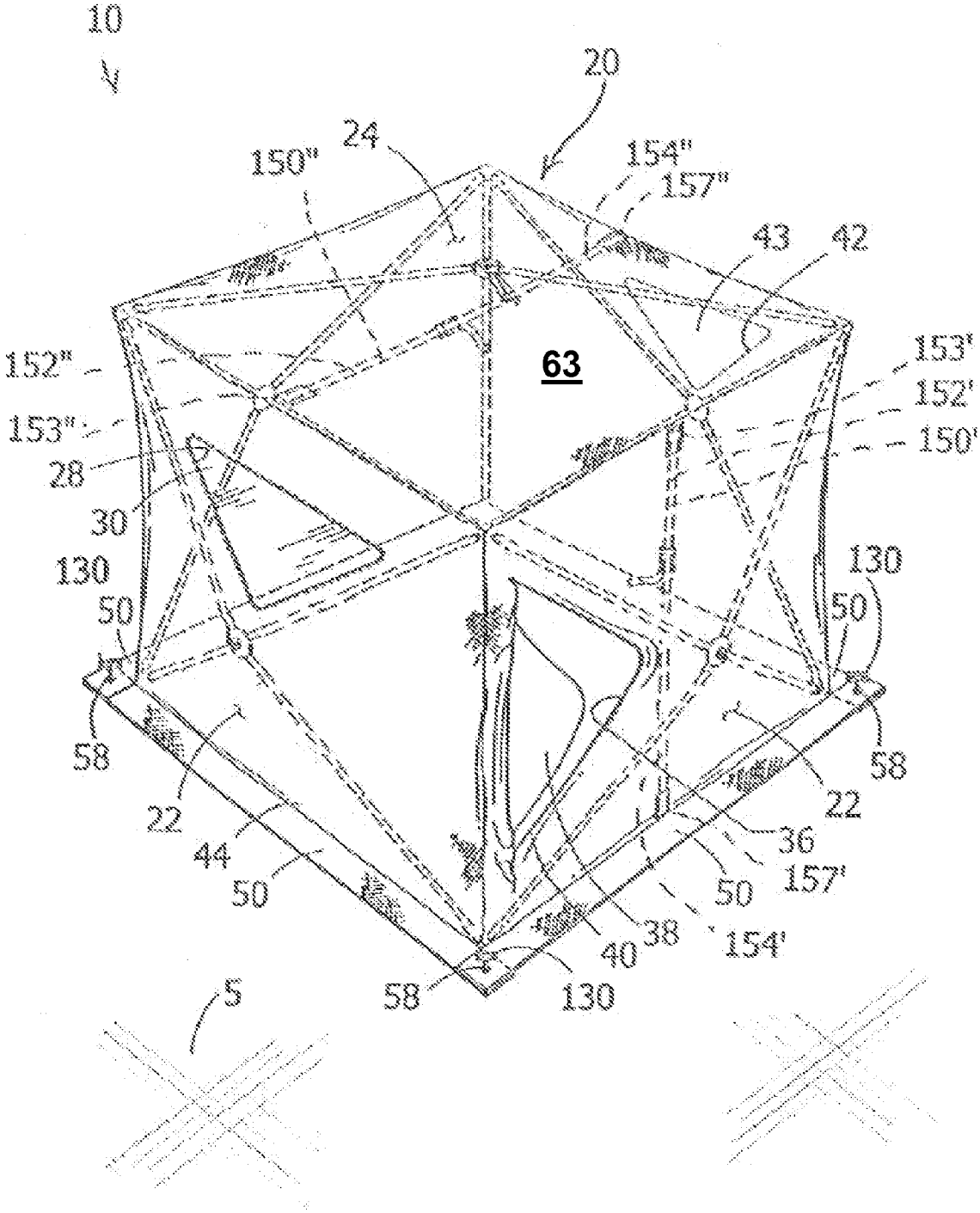
FIG. 1 is an elevated perspective view of an assembled portable outdoor structure according to a first illustrative embodiment of the present invention, showing the skirt portions at the lower edge of the covering, and also showing the internal sub-frames and tensioning straps in phantom.

An illustrative embodiment of an inventive portable ice fishing enclosure according to the present invention will now be described, with reference to the drawing Figures. As shown in FIG. 1, in a fully assembled configuration thereof, a portable ice fishing enclosure 10 according to the selected embodiment includes a flexible outer covering, or shell, 20 supported by a frame 70, and secured to a supportive substrate 5 using a plurality of anchor stakes 130. The enclosure hereof is particularly adapted for use on an ice sheet as a supportive substrate 5.

The covering 20 is cooperatively supported by, and overlies the frame 70. The covering 20 provides an outer shell for the portable enclosure 10, and is formed of flexible sheet material. In the illustrated embodiment, the flexible sheet material is a woven synthetic fabric to provide the durability, flexibility and strength required for use in harsh environmental conditions.

The covering 20 includes a plurality of interconnected sidewalls 22 and a ceiling 24. The sidewalls 22 are arranged in a lateral edge-to-edge relationship, such that each of the sidewalls 22 is joined to an adjacent sidewall at each of its respective lateral edges, to form a closed section. The ceiling 24 is joined, at its peripheral edges, to the respective upper edges of the sidewalls 22, to close the upper end of the portable enclosure 10. The lower end of the portable enclosure 10 may be left open to allow the user to have access to substantially the entire ground surface area within the surrounding sidewalls.

Alternatively, if desired, a bag used to house and store the enclosure in a collapsed configuration thereof may be adapted to be used as a floor in the assembled configuration of the enclosure, to cover part or all of the floor area inside of the enclosure.

The Outer Shell

In the first illustrative embodiment of the invention, shown in FIG. 1, the covering 20 of the enclosure 10 consists of four sidewalls 22 and a ceiling 24. However, it is within the scope of the invention to use only three sidewalls, or more than four sidewalls. For example, for a larger enclosure, five or six sidewalls may be provided.

One or more of the sidewalls 22 may be provided with a window opening 28. A transparent vinyl sheet insert 30 may be sewn over window opening 28, to allow natural light to enter into the interior space within the portable enclosure 10. The transparent vinyl sheet insert 30 may be covered with a selectively movable flexible window flap (not shown). If desired, only a portion of one edge of the transparent vinyl insert 30 may be fixed to a corresponding edge of the window opening 28 so as to allow the transparent vinyl insert 30 to be selectively openable. A selectively openable transparent vinyl insert 30 may also be layered over a screen insert (not shown).

The portable enclosure 10 includes at least one selectively closable door opening 36 formed in a sidewall 22, to permit ingress into, and egress from the enclosure 10. In the depicted embodiment, the door opening 36 is a closable door flap 38 that is secured to the sidewall 22 using conventional door closure means 40, which may include, but is not limited to, hook and loop fasteners, zippers, snaps, or ties.

A vent opening 42 is formed in the ceiling 24, and comprises a breathable vent insert 43 sewn therein which prevents environmental precipitation from entering into the interior of the enclosure 10, and which also allows adequate ventilation of the structure. The vent opening 42 may include a closable flap of fabric on the interior of the covering 20, and a screen panel may be provided as the vent insert 43.

Figure 3:
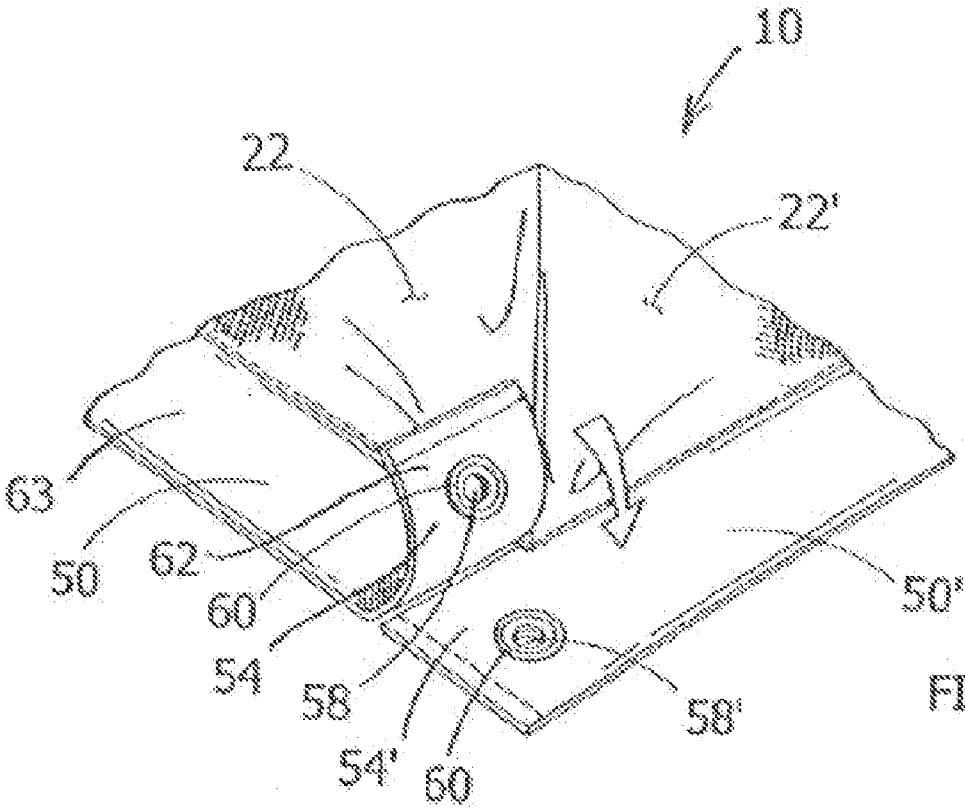
FIG. 3 is a detail view of a lower corner of the covering portion of the structure, showing the end portion of the skirt from one sidewall extending laterally outwardly beyond the sidewall, and the end portion of the skirt from an adjacent sidewall arranged to overlap it.

The lower edge 44 of each sidewall 22 has a skirt portion 50 attached thereto along the entire width thereof, and the outer ends of skirt portion extend beyond the sidewall 22 at each side thereof. The skirt portion 50 is an elongate rectangular band formed of the same material as the tent body, and has a width that is greater than the width of the sidewall 22. The skirt portion 50 extends continuously along the entire lower edge 44 of the sidewall 22 such that the respective ends 54 of the skirt portion 50 extend beyond both lateral edges of the sidewall 22 (FIG. 3). Each end 54 of the skirt portion 50 is provided with a through hole 58. The edges of the through hole 58 are reinforced. In the illustrated embodiment, the through hole 58 is reinforced with a metal or high-strength plastic grommet 60.

In the assembled configuration of the enclosure 10, the sidewalls 22 extend substantially vertically upwardly, with each sidewall bowed slightly outwardly by its respective sub-frame 72 (FIG. 2), and the skirt portion 50 for each sidewall 22 extends out parallel to the substrate 5 and perpendicular to the sidewall 22, so as to overlie and confront the surface of the substrate 5.

Figure 4:
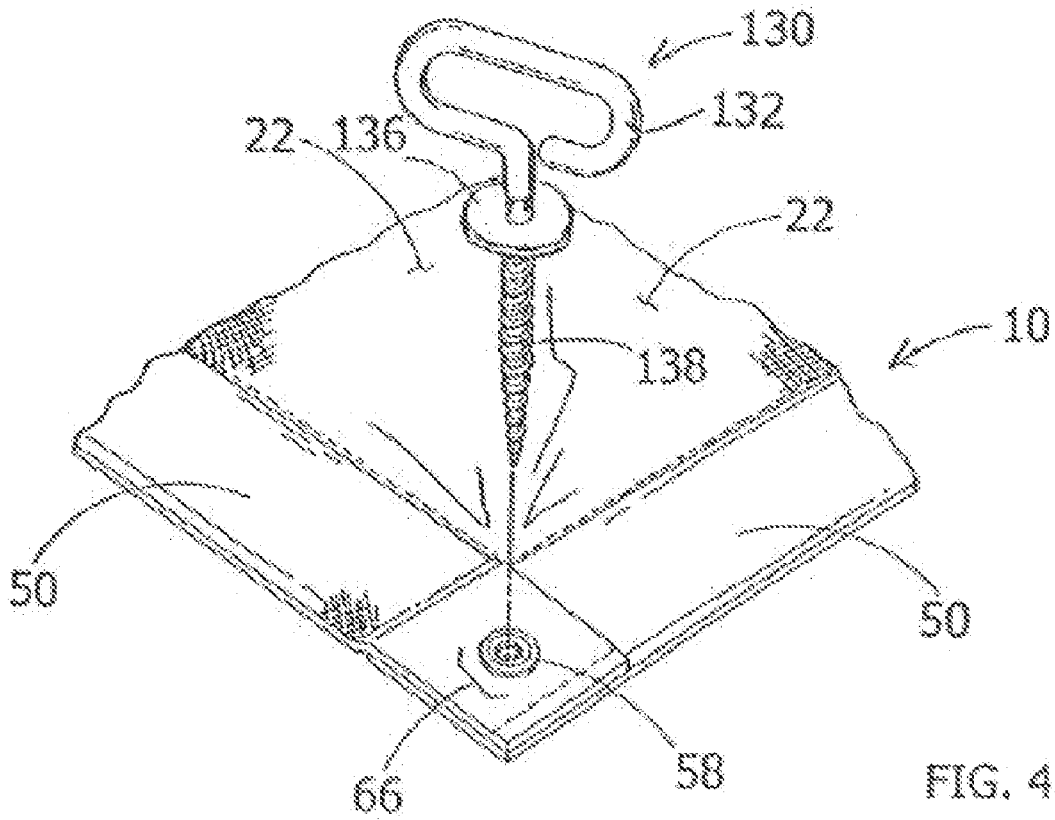
FIG. 4 is a detail view of the lower corner of the covering similar to FIG. 3, showing the respective end portions layered such that the grommets lie in vertical alignment, and showing, in an exploded manner, a stake positioned for insertion through the aligned grommets.

As shown in FIGS. 3-4, in the assembled configuration of the enclosure, the respective end flaps of adjacent skirt portions overlap one another at the corners of the covering 20, to provide a strong support for the enclosure when the overlapped end flaps are attached to the substrate 5. At the corners of the portable enclosure 10, the respective ends 54 of the skirt portions 50 for adjacent sidewalls are arranged to lie in a layered, overlapping relationship. That is, the end 54 of the skirt portion 50 of one sidewall 22 overlies the end 54' of the skirt portion 50' of the adjacent sidewall 22', so that the through hole 58 of the end 54 of the skirt portion 50 of the one sidewall overlies and is in vertical alignment with the through hole 58' of the end 54' of the skirt portion 50' of the adjacent sidewall 22', to form a vertically aligned through hole pair 66. Each through hole 58 of the through hole pair 66 is sized to receive the shank 134 of the anchor stake 130 therethrough, and has a diameter which is smaller than the diameter of the anchor stake's flange 136.

The Frame

Figure 2:
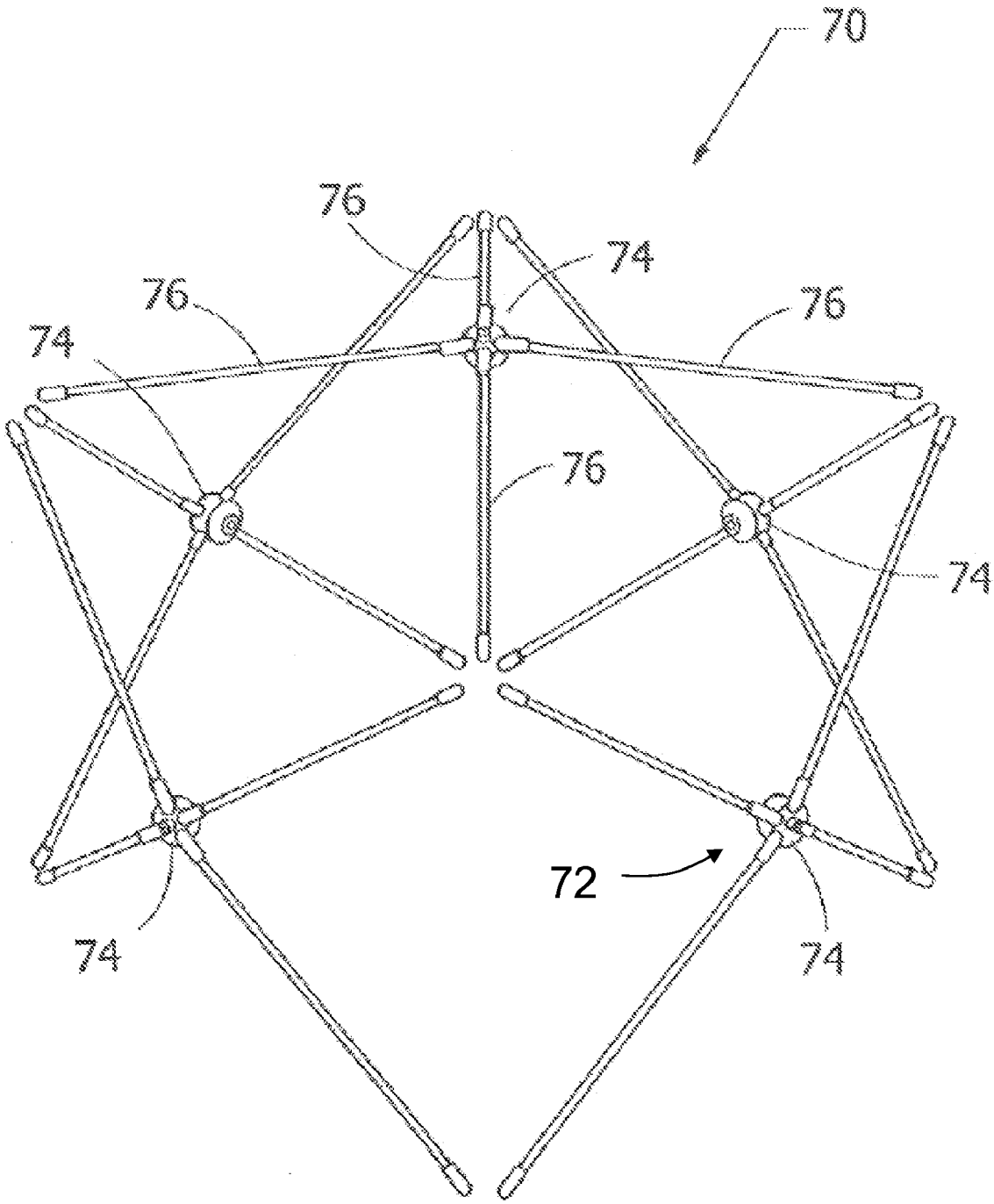
FIG. 2 is a top perspective view of the internal frame structure of the structure of FIG. 1, with the covering deleted from the drawing for illustrative purposes.

Referring now to FIG. 2, the frame 70 cooperates with the covering 20 to provide a three-dimensional enclosure which is free standing, lightweight, and easily assembled and disassembled. In the depicted embodiment of the enclosure 10, the frame 70 includes five sub-frames 72 such that a separate sub-frame 72 is provided for the ceiling 24, and a sub-frame is also provided for each of the four respective sidewalls 22. In the embodiment of FIGS. 1-2, the individual sub-frames 72 are not connected to one another. When assembled with the covering 20, the individual sub-frames 72 are discontiguous with each other.

Each sub-frame 72 includes a substantially cylindrical central hub 74, and further includes a plurality of poles 76, which are pivotally mounted to the hub 74 and extend outwardly therefrom. In the illustrated embodiment, four poles 76 are provided for each hub. However, it is within the scope of this invention to provide a hub having a fewer or greater number of poles 76. For example, a greater number of poles 76 might be required to accommodate a non-rectangular sidewall 22.

Figure 5:
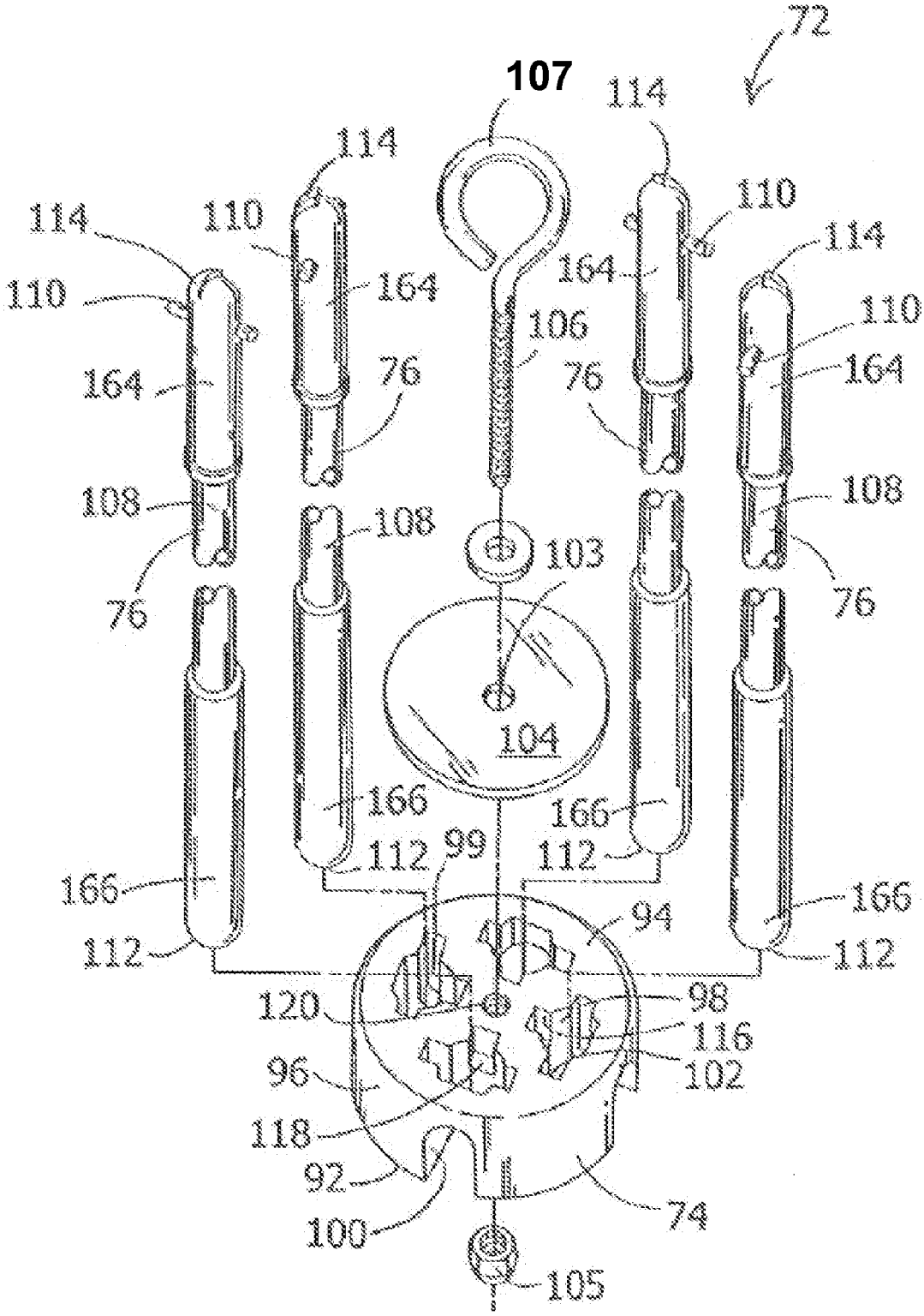
FIG. 5 is an exploded detail view showing the components of one sub-frame of the frame structure of FIG. 2, including the hub, the hub cap plate, and the poles.
Figure 6:
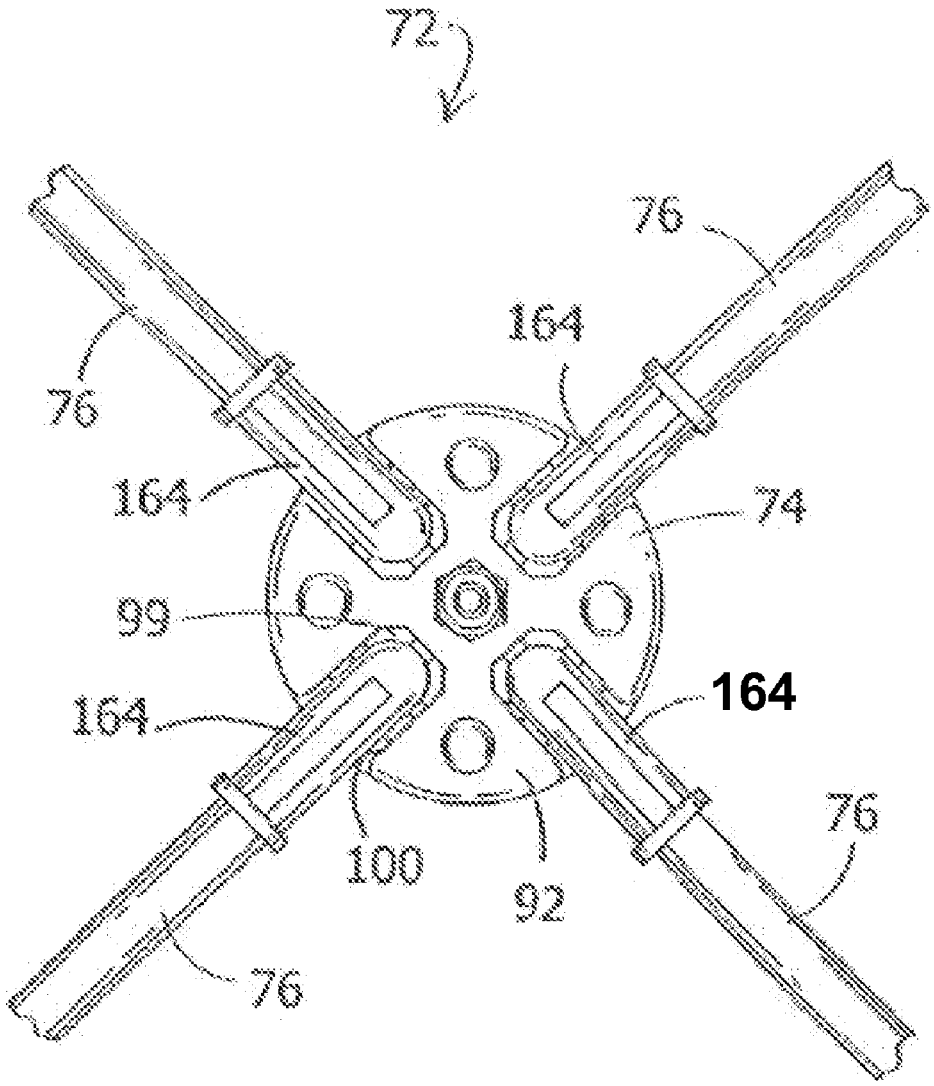
FIG. 6 is a detail view of the hub portion of the sub-frame of FIG. 3, viewed from a vantage point outside of the sub-frame, with the fabric of the shelter wall omitted from the drawing for illustrative purposes.

As seen in FIGS. 5 and 6, the hub 74 is a substantially cylindrical block, which is formed from a strong, substantially solid plastic or metal material having a number of openings formed therein, as will be further described. The hub 74 has an outer face 92 for placement facing toward the interior of the portable enclosure 10, and an inner face 94 for placement facing inwardly away from the interior surface of the covering 20, when the portable enclosure is assembled. The hub 74 has an arcuate peripheral edge surface 96 extending between the inner face 94 and the outer face 92.

The hub 74 also has a plurality of mounting apertures 98 formed therein. One mounting aperture 98 is provided for each pole 76. The mounting apertures 98 are positioned so as to surround, and be equidistantly spaced about, the axial centerline of the hub 74. Each mounting aperture 98 includes a shaped through hole 99 and a radial groove 100 extending from a respective through hole 99. The through holes 99 extend through the block of the hub 74, between the inner face 94 and the outer face 92. The inner surface of each through hole 99 is irregularly shaped, and includes both a pair of opposed key slots 102 and a stop slot 116. The hub 74 has a stop surface 118 formed therein at a lower end of the stop slot 116.

Each mounting aperture 98 further includes a radially extending groove 100 formed in the outer face 92 thereof, as noted. Each of the radial grooves 100 extends radially inwardly from the peripheral edge surface 96 so as to terminate at and communicate with a respective mounting aperture 98. In the illustrated embodiment, four poles 76 are provide for each hub 74, and thus each hub 74 includes four mounting apertures 98.

Each pole 76 consists of an elongate semi-rigid rod having a shaped hub end 164 for mounting within the mounting apertures 98, and a distal end 166 opposed to the hub end 164. The rod may be made of a strong, flexible material such as plastic, a carbon composite tube, or fiberglass. The hub end 164 of each pole 76 includes a transversely extending pin which forms a key 110 positioned adjacent to the terminus of the hub end 164, and also includes a narrow, outwardly extending stop 114 formed on the terminus of the hub end 164. During assembly and in use, the key 110 is received within and pivotably supported by the key slots 102 of the through hole 99. Likewise, the stop 114 is supported by the stop surface 118 in the stop slot 116 of the through hole 99.

Once assembled, each pole 76 is positioned within the hub 74 such that the hub end 164 resides within a mounting aperture 98. Specifically, in the unfolded and opened position of the sub-frame 72 shown in FIGS. 2 and 6, the key 110 resides within the key slots 102, the stop 114 abuts the stop surface 118, and the hub end of the pole 76 resides within a corresponding radial groove 100. In this fully opened configuration, the body portion 108 of the pole 76 extends radially outwardly from the peripheral edge surface 96 of the hub 74 (FIG. 6).

Once the poles 76 are positioned within the respective mounting apertures 98, the inner face 94 of the hub 74 is covered with a circular metal washer 104. The washer 104 includes a central hole 103, which aligns with a threaded bolt hole 120 formed through the axial centerline of the hub 74. The washer 104 is maintained on the inner face 94 of the hub 74 using a threaded bolt 106, extending through both the central hole 103 of the washer 104 and the bolt hole 120 of the hub 74, and secured with a nut 105. The inner end of the bolt 106 is looped to form an eye 107. Eye 107 provides a means for grasping the hub 74, and may support a short pull strap to enhance that function.

Figure 7:
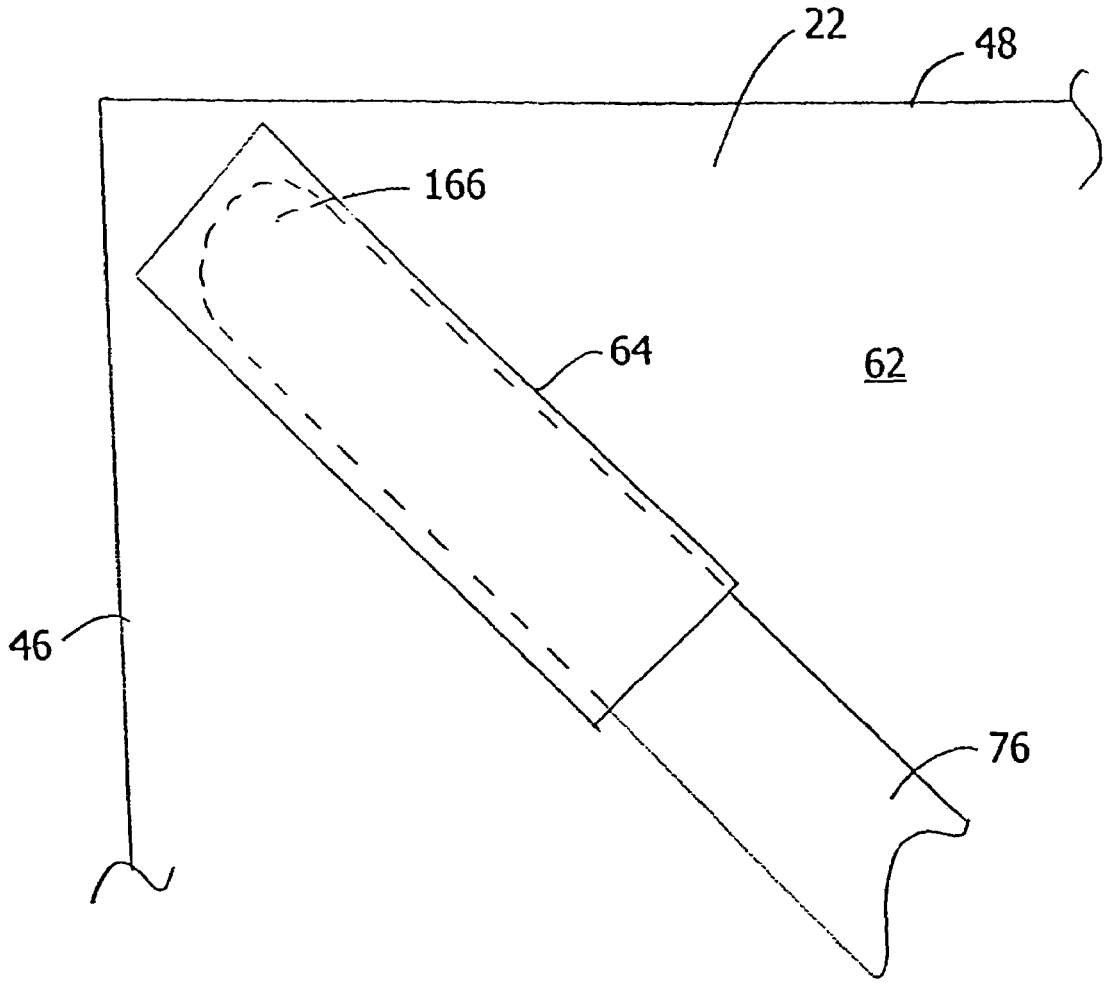
FIG. 7 is a detail view of a corner of a sidewall of the structure of FIG. 1 as viewed from the inside of the shelter, showing the distal end of a pole secured to the inner surface of the covering by insertion within a pocket formed on the inner surface of the covering.

Each sub-frame 72 is cooperatively supported in space by the covering 20, such that sub-frames 72 on adjacent portions of the portable enclosure 10 are not in physical contact with one another. The distal ends 166 of each respective pole 76 include tip portions 112, which are received in and supported by pockets 64 formed on the interior surface 62 of the covering 20 (FIG. 7). A pocket 64 is provided near each corner of the ceiling and of each sidewall 22, such as at a corner portion of a sidewall near an area where adjacent edge portions 46, 48 of the sidewall intersect, as shown, and the pocket is aligned with a line extending between diagonally opposed corners. This configuration complements the orientation of the poles 76 as they extend outward from hub 74. Thus, the frame 70 is cooperatively engaged with the cover 20, such that each individual sub-frame 72 is supported by a portion of the covering 20, and such that the plurality of sub-frames provide support and structure to the covering 20 to result in a freestanding, three dimensional construction.

Tensioning Straps

A tensioning strap 150 may, optionally, be provided on the interior surface 62 of the covering 20 for use with one or more panels thereof. Thus one or more of the sidewalls 22 and the ceiling 24 of the portable enclosure 10 may be provided with a tensioning strap 150. Each tensioning strap 150, where used, includes strap sections 152, 154 which extend between a pair of opposed edges of a respective portion of the covering 20, such as a sidewall 22 or ceiling 24, and these strap sections 154, 154 are centrally joined using a tensioning mechanism 160. The tensioning mechanism 160 can be of a conventional type similar to a known tensioning mechanism used in automotive safety belts, which allows a single-direction adjustment of the effective overall length of the strap sections 152, 154.

Figure 10:
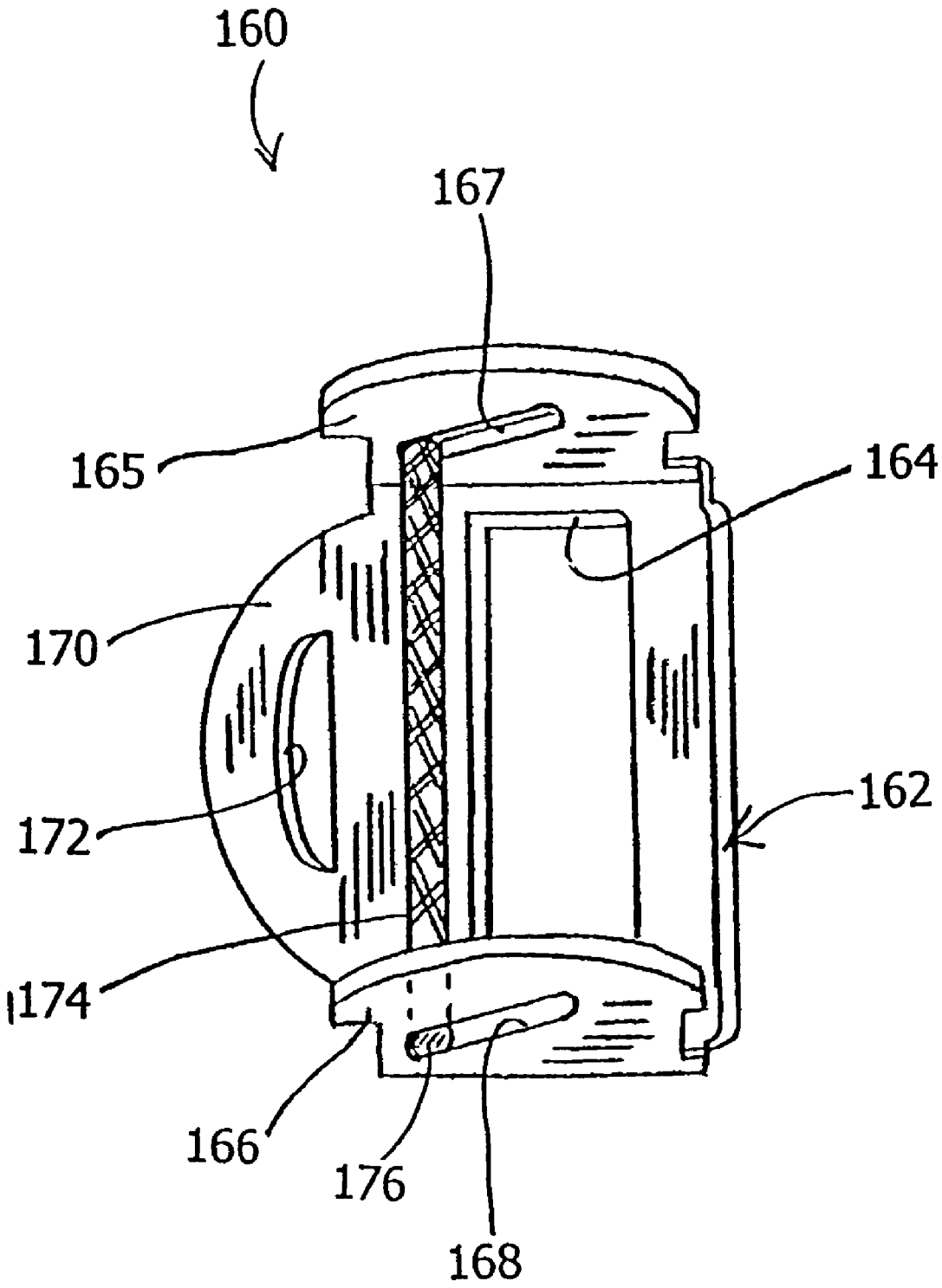
FIG. 10 is a perspective view of the tensioning mechanism isolated from the tensioning straps, showing the textured bar overlying the base plate.
Figure 11:
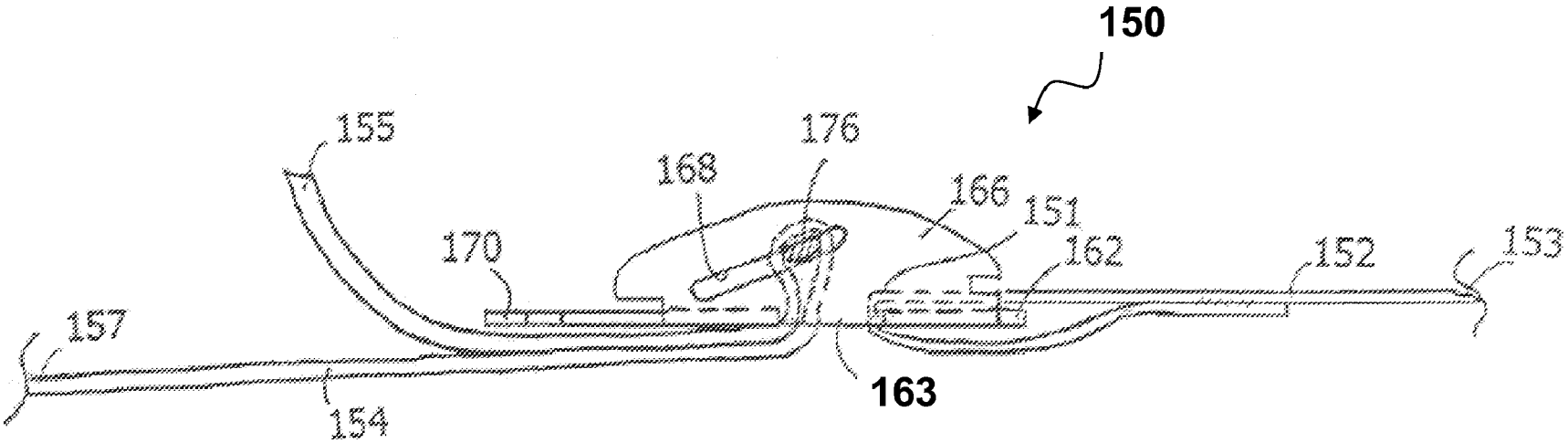
FIG. 11 is a side view of the tension-producing member, showing the tensioning straps extending from the tensioning mechanism.

The internal structure of one example of a tensioning mechanism 160 is shown in FIGS. 10 and 11. As seen in FIG. 10, the tensioning mechanism 160 includes a base plate 162 having parallel sides and having an opening 163 formed therein. A pair of opposed side flanges 165, 166 are integrally attached to and extend upwardly from the respective parallel sides of the base plate 162. Each of the side flanges 165, 166 has a respective slot 167, 168 formed therein, oriented at an upwardly sloping angle with respect to the base plate 162. The base plate 162 includes a release flange 170 having a hole 172 formed therein. If desired, a release strap may be secured to release flange 170 using the hole 172. The tensioning mechanism 160 further includes a textured bar 174 extending between the side flanges 165, 166, with the ends 176 of the bar 174 slidably disposed in the slots 167, 168 thereof. Although the inventive portable enclosure is described is illustrated using tensioning mechanism 160, it is within the scope of this invention to use other tensioning devices, such as, but not limited to, a ratcheting tensioner.

In the tensioning strap 150 according to the present invention, a first, adjustable length strap 154 is formed of a strong, flexible material. An example of such a material includes, but is not limited to, nylon webbing. Adjustable length strap 154 has opposed first and second ends 155, 157, and is pre-threaded through the tensioning mechanism 160. A user of the apparatus is not required to remove the adjustable length strap 154 from the tensioning mechanism 160, or to re-thread the adjustable length strap 154 therethrough at any time during the life of the mechanism, under normal circumstances.

The tensioning strap 150 further includes a second, fixed length strap 152 operatively attached to the adjustable length strap 154 via the tensioning mechanism 160. The fixed length strap 152 is formed of a strong, flexible material, similar to the material of the adjustable length strap 154. The fixed length strap 152 has opposed first and second ends 151, 153. The first end 151 of the fixed length strap 152 is operatively and non-adjustably attached to the tensioning mechanism 160. This may be accomplished by passing the end of the strap around the end of the base plate 162, through the opening 163, and sewing the strap back on itself, as shown in FIG. 11. The second end 153 of the fixed length strap is operatively and non-adjustably attached to the edge portion of the sidewall (or ceiling).

As seen in FIG. 11, the first end 155 of the adjustable length strap 154 is fed through the opening 163 in the base plate 162 in the direction shown, passed around the bar 174 in the direction of the release flange 170, and is then fed back through the opening 163. The first end 155 of the adjustable length strap 154 is allowed to hang freely. The second end 157 of the adjustable length strap 154 is operatively and non-adjustably attached to the edge portion of the sidewall (or ceiling) which is opposed to the edge portion upon which the second end 153 of the fixed length strap is secured. Thus as seen in FIG. 1, the tensioning strap 150 spans a respective portion of the covering, such as a sidewall 22 or ceiling 24, such that the strap members 152, 154 are fixed to opposed edges of the portion of the covering.

For example, in FIG. 1, a first tensioning strap 150' is shown on a sidewall 22 and a second tensioning strap 150" is shown on the ceiling 24. Although not shown, a tensioning strap 150 may be provided on additional sidewalls 22, as needed. With respect to the first tensioning strap 150' on the sidewall 22, the second end 153' of the fixed length strap 152' is fixed to the upper edge of the sidewall 22, and the second end 157' of the adjustable length strap 154' is fixed to the lower edge of sidewall 22. Similarly, with respect to the second tensioning strap 150" on the ceiling 24, the second end 153" of the fixed length strap 152" is fixed to a first lateral edge of the ceiling 24, and the second end 157" of the adjustable length strap 154" is fixed to an opposed lateral edge of the ceiling 24.

As seen in FIG. 1, adequate tension is provided by inversion of the sub-frames in the open assembled configuration thereof, so that the distal ends 166 of each pole 76 are flexed inwardly toward the center of the portable enclosure 10, and so that the hub is pressed outwardly, away from the center of the portable enclosure 10 and against the covering 20.

When setting up the enclosure 10, the distal ends of the poles are inserted into the corresponding pockets at the corners of a selected sidewall panel 22, with the outer face 92 of the hub oriented facing outwardly, against the material of the sidewall. The hub is then pushed outwardly until it bows out past the corners of the sidewall 22, in a gently bowed configuration similar to an open, unfurled umbrella.

The Anchor Stakes

Figure 8:
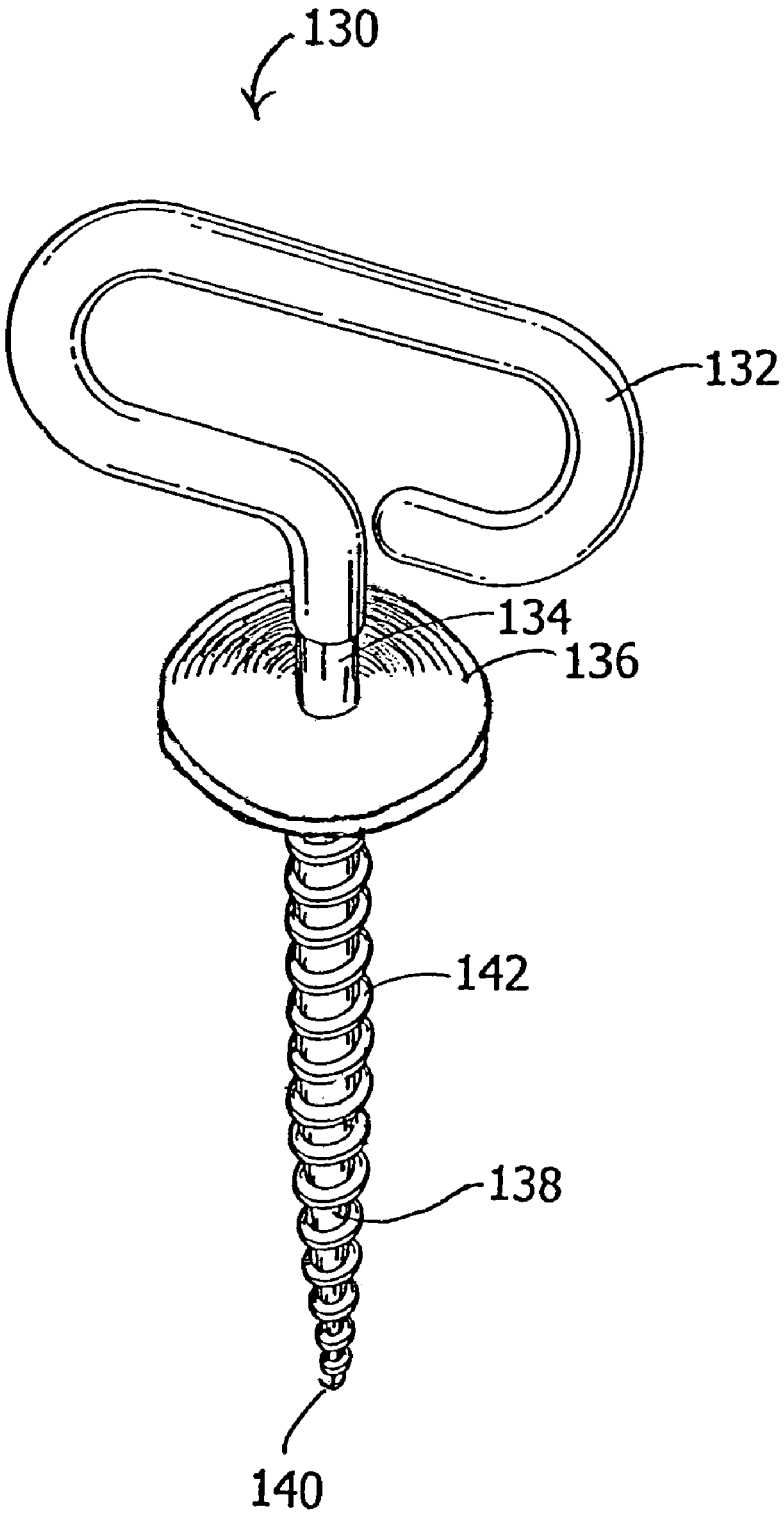
FIG. 8 is a perspective view of a stake used for attaching the structure of FIG. 1 to a supportive substrate, illustrating the threaded lower end, a handle formed on the upper end, and a wide flange provided between the upper end and lower end.

The portable enclosure 10 is maintained in contact with the ice or other substrate surface 5 using a plurality of anchor stakes 130 (FIG. 8) which cooperatively engage the through hole pair 66 formed in the skirt portions 50 at each corner of the portable enclosure 10 (FIG. 4). Each anchor stake 130 comprises an elongate shank 134.

The upper end of the shank 134 is shaped to form a handle 132. The handle is sized and shaped to allow adequate gripping and leverage for manual rotation of the anchor stake during use. In the illustrated embodiment, the handle is shaped to form an elongated loop, but it may also be formed in other shapes, including a T-shape. The handle may be provided with a insulative covering, such as rubber or a suitable elastomeric coating, for improved comfort and grippability when used in cold environments.

Figure 9:
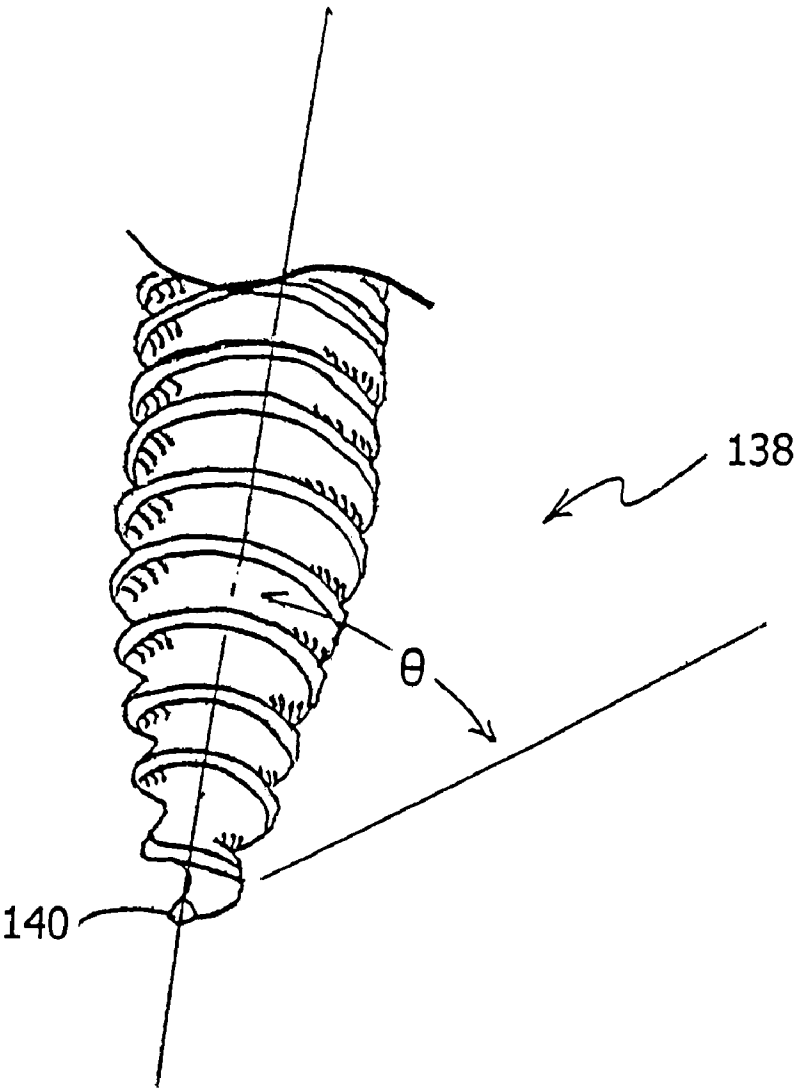
FIG. 9 is a detail view of the of the lower tip end of the stake of FIG. 8, showing the helical shape of the lower end, and the angle θ of the terminal tip relative to the longitudinal axis of the stake.

The lower end 138 of the shank 134 is tapered, and terminates in a pointed tip 140. For ease of threading into an ice surface 5, the tapered portion may be two inches or more in length. The lower end 138 is provided with coarse exterior threads 142, and at the tip 140 the shank 134 is provided with a generally helical shape, in the manner of a corkscrew. As a result, the tip 140 is oriented at an angle θ relative to the longitudinal axis of the shank 138 (FIG. 9). This configuration of the shank 134, wherein the outer surface is threaded and the tip 140 is angled, are features which allow the anchor stake 130 to be manually screwed into the surface 5 of the ice with only moderate effort.

Each anchor stake 130 is also provided with a flange 136 formed between the handle 132 and the lower end 138. The flange 136 is a thin plate extending in a direction normal to the longitudinal axis of the shank 134. The flange 136 has an outer diameter that is greater than the diameter of the reinforcing grommets 60 of the through holes 58 formed at each end 54 of the skirt portion 50. To prevent the flange 136 from passing through the grommets 60, the diameter of the flange 136 should be at least twice the diameter of the through holes formed in the grommets 60. In use, the lower end 138 of anchor stake 130 is inserted into a through hole pair 66 of the skirt portion 50, and is drawn into the surface of the substrate 5 by manually turning the handle 132. The flange 136 provides a stop surface when anchor stake 130 is sufficiently screwed into the ice, such that the layered ends 54, 54 of the skirt portion 50 are tightly sandwiched between the ice surface 5 and the flange 136. Use of a threaded anchor stake provides simple and quick securement to the ice surface, in contrast to a prior art method of chipping a hole for a stake, and adding water to freeze the stake therein.

Second Embodiment—Overview

Figure 13:
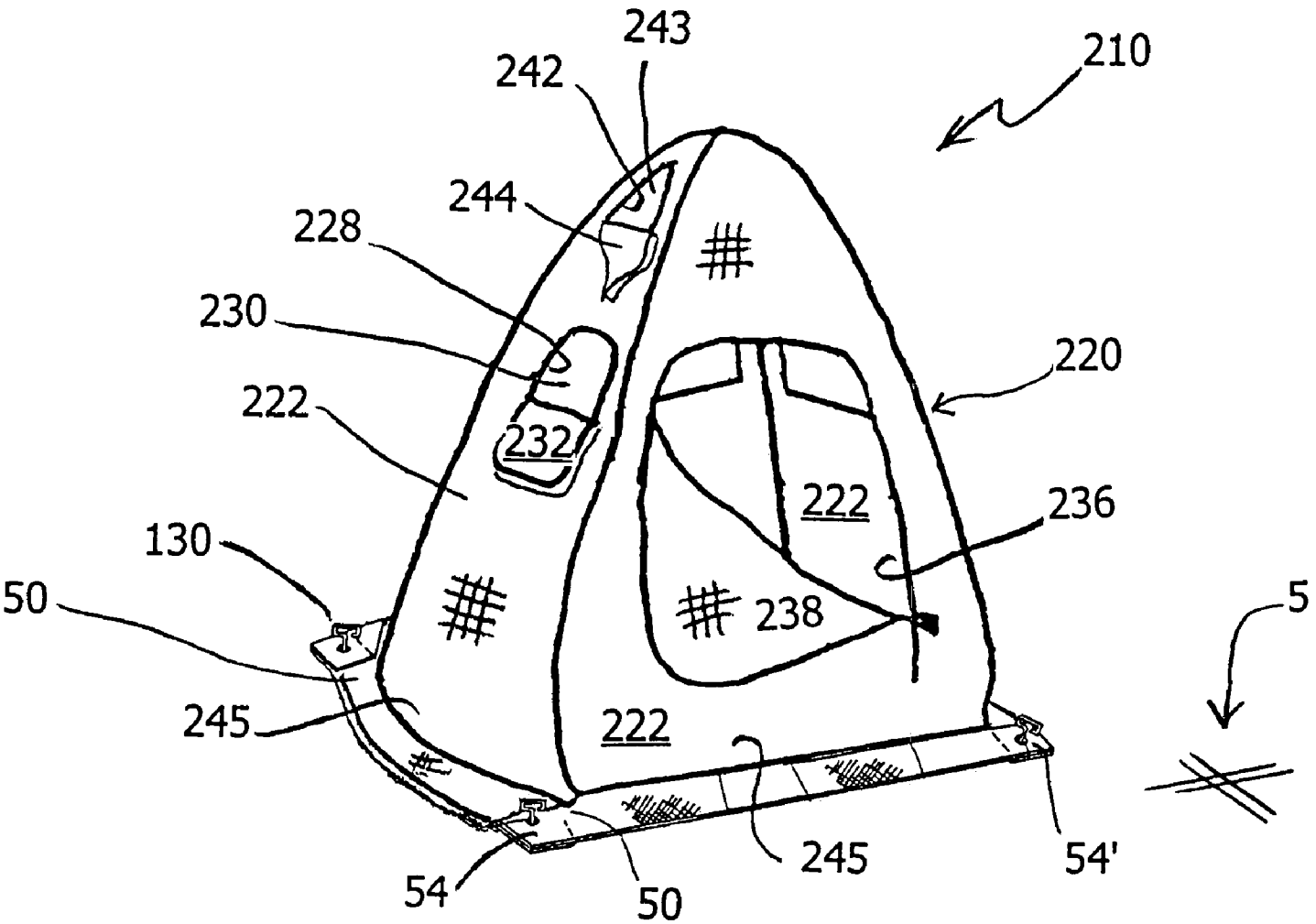
FIG. 13 is an elevated perspective view of an assembled portable outdoor structure according to another illustrative embodiment of the present invention, showing the skirt portions at the lower edge of the covering.
Figure 14:
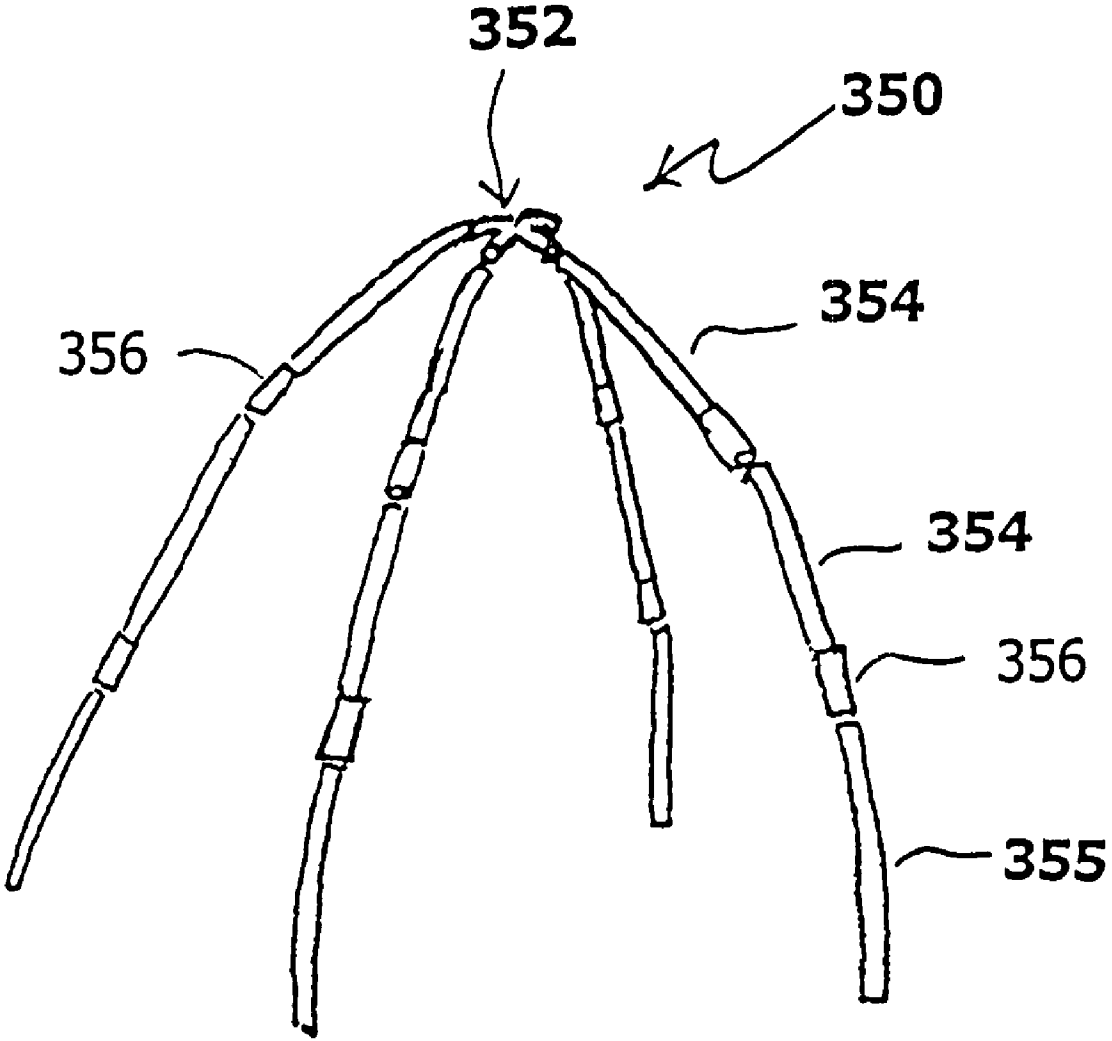
FIG. 14 is a top perspective view of a frame structure for the structure of FIG. 13, with the covering deleted from the drawing for illustrative purposes.

As shown in FIGS. 13-14, in a fully assembled configuration thereof, a portable ice fishing enclosure 210 according to another illustrative embodiment of the present invention includes a flexible shell 220 supported by a frame 350 (FIG.

14), and secured to a supportive substrate 5 using a plurality of anchor stakes 130. The enclosure 210 hereof is particularly adapted for use on an ice sheet as a supportive substrate 5.

The shell 220 is cooperatively supported by the frame 350, which may be set up for placement either inside or outside of the shell. The shell 220 for the portable enclosure 210 is formed of flexible sheet material, which may be nylon or another woven synthetic fabric to provide the durability, flexibility and strength required for use in harsh environmental conditions.

The shell 220 includes a plurality of interconnected sidewalls 222. The sidewalls 222 are arranged in a lateral edge-to-edge relationship, such that each of the sidewalls 222 is joined to an adjacent sidewall at each of its respective lateral edges, to form a substantially closed section.

In the embodiment of FIG. 13, each of the sidewalls 222 making up the shell has a substantially arch-shaped outline, similar to an inverted parabola, as shown, giving the overall structure a modified dome shape. The lower end of the portable enclosure 210 may be left open to allow the user to have access to substantially the entire ground surface area within the surrounding sidewalls.

Alternatively, if desired, a bag used to house and store the enclosure in a collapsed configuration thereof may be adapted to be used as a floor in the assembled configuration of the enclosure, to cover part or all of the floor area inside of the enclosure 210.

The Outer Shell

In the embodiment shown in FIG. 13, the covering 220 of the enclosure 210 includes four interconnected sidewalls 222. However, it is within the scope of the invention to use only three sidewalls, or more than four sidewalls. For example, for a larger enclosure, five or six sidewalls (not shown) may be provided.

One or more of the sidewalls 222 may be provided with a window opening 228. A transparent vinyl sheet insert 230 may be sewn over the window opening 228, to allow natural light to enter into the interior space within the portable enclosure 210. The transparent vinyl sheet insert 230, where used, may be covered with a selectively movable flexible window flap 232. If desired, only a portion of one edge of the transparent vinyl insert 230 may be fixed to a corresponding edge of the window opening 228, so as to allow the transparent vinyl insert 230 to be selectively openable. A selectively openable transparent vinyl insert 230 may also be layered over a screen insert (not shown).

The portable enclosure 210 includes at least one selectively closable door opening 236 formed in a sidewall 222, to permit ingress into, and egress from the enclosure 210. In the depicted embodiment, the door opening 236 is a closable door flap 238 that is secured to the sidewall 222 using a conventional door closure which may include, but is not limited to, hook and loop fasteners, zippers, snaps, or ties.

A vent opening 242 is formed in an upper portion of one of the sidewalls 222, and comprises a breathable vent insert 243 sewn therein, which allows adequate ventilation of the structure. The vent opening 242 may include a closable flap of fabric 244 on the interior or exterior of the covering 220, and a screen panel may be provided as the vent insert 243.

The lower edge 245 of each sidewall 222 has a skirt portion 50 attached thereto along the entire width thereof, and the outer ends of the skirt portion extend beyond the sidewall 222 at each side thereof. The skirt portion 50 is an elongate rectangular band formed of the same material as the sidewalls, and has a width that is greater than the width of the sidewall 222. The skirt portion 50 extends continuously along the entire lower edge 245 of the sidewall 222, such that the respective ends 54, 54' of the skirt portion 50 extend beyond the respective lateral edges of the sidewall 222. Each end 54, 54' of the skirt portion 50 is provided with a through hole 58. The edges of the through hole 58 are reinforced. In the illustrated embodiment, the through hole 58 is reinforced with a metal or high-strength plastic grommet 60.

In the assembled configuration of the enclosure 210, the sidewalls 222 extend substantially upwardly at an angle inclined towards the center, and the skirt portion 50 for each sidewall 222 extends out parallel to the substrate 5 and perpendicular to the sidewall 222, so as to overlie and confront the surface of the substrate 5.

As shown in FIGS. 3-4, in the assembled configuration of the enclosure, the respective end flaps of adjacent skirt portions overlap one another at the corners of the covering 220, to provide a strong support for the enclosure when the overlapped end flaps are attached to the substrate 5. At the corners of the portable enclosure 210, the respective ends 54, 54' of the skirt portions 50 for adjacent sidewalls are arranged to lie in a layered, overlapping relationship. That is, the end 54 of the skirt portion 50 of one sidewall 222 overlies the end 54' of the skirt portion 50' of the adjacent sidewall 22', so that the through hole 58 of the end 54 of the skirt portion 50 of the one sidewall overlies and is in vertical alignment with the through hole 58' of the end 54' of the skirt portion 50' of the adjacent sidewall 22', to form a vertically aligned through hole pair 66. Each through hole 58 of the through hole pair 66 is sized to receive the shank 134 of the anchor stake 130 therethrough, and has a diameter which is smaller than the diameter of the anchor stake's flange 136.

The Frame

The support frame 350 for the enclosure of FIG. 13 is illustrated in FIG. 14, and includes a central connector 352. In the embodiment of FIG. 14, the central connector 352 is X-shaped. A plurality of interconnecting poles 354, 355 and are used together with the central connector 352 to construct the frame 350. The poles 354, 355 are made of strong, semi-flexible fiberglass or plastic material, and some of the poles 354 have integral sleeves 356 to receive an end of another pole therein.

It will be understood that suitable fabric or elastic loops may be provided on the interior or the exterior upwardly extending seams of the shell, to receive the frame pole sections 354, 355 therein.

Kit

Figure 12:
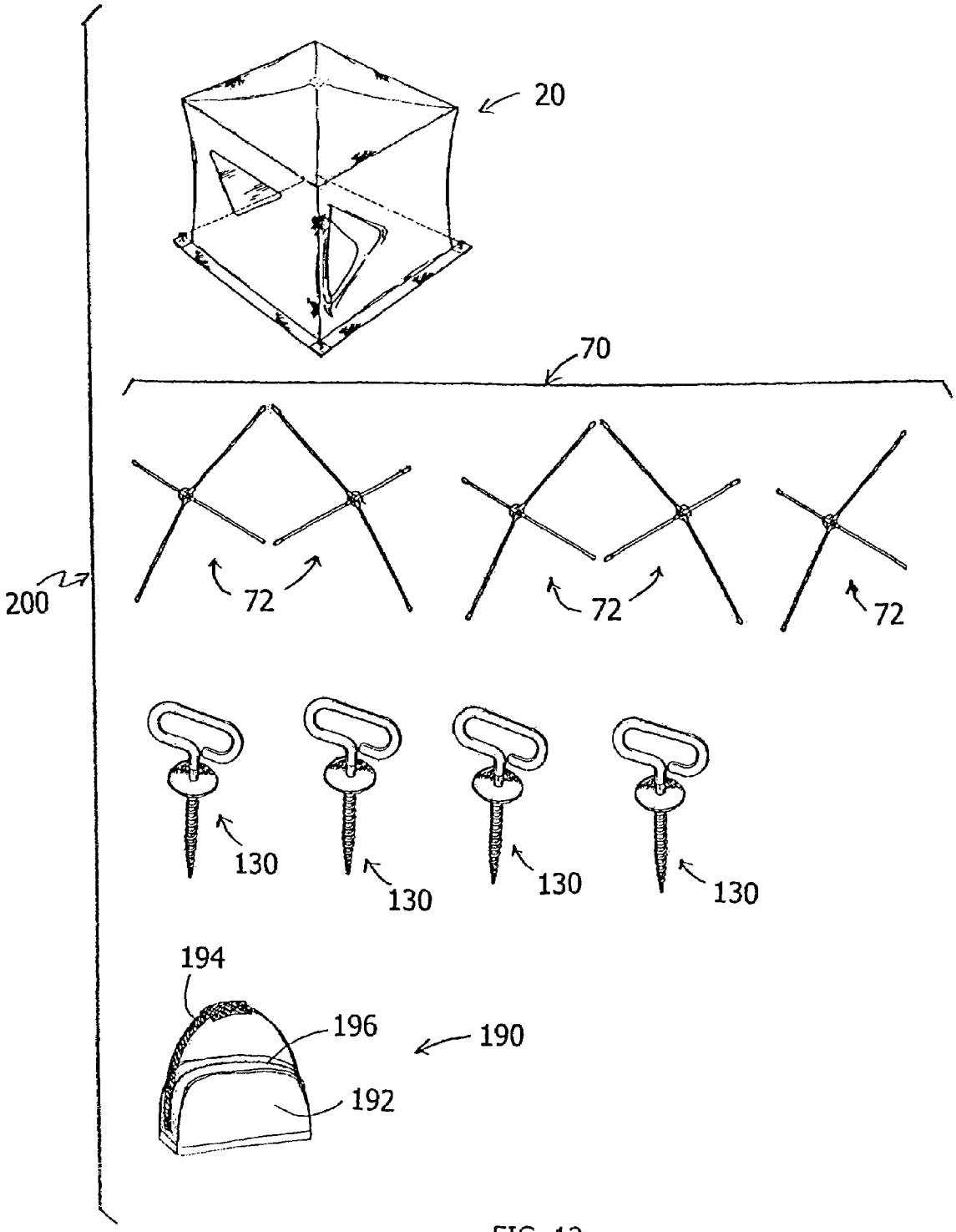
FIG. 12 is an illustration of a kit according to another embodiment of the invention, including a covering, a frame consisting of five sub-frames, a plurality of stakes, and a carrying bag.

The present invention also provides a kit 200 (FIG. 12) for use in constructing a portable ice fishing enclosure 10 which is lightweight, easily transported and easily assembled and disassembled, even in cold and windy winter conditions. The kit 200 includes the portable ice fishing enclosure 10 and a carrying bag 190. The portable ice fishing enclosure 10 includes the covering 20, the frame 70, and anchor stakes 130 as described above.

The carrying bag 190 has an elongate, generally cylindrical body portion 192 sized to receive the folded covering, disassembled frame 70, and anchor stakes 130 therein. The body portion 192 of carrying bag 190 is a flexible sturdy fabric, and includes an elongate opening 196 which is selectively opened and closed using conventional means, such as a zipper or hook and loop fastener. The carrying bag also includes at least one carrying strap 194 which may be sized and adapted or grasping in the user's hand or for supporting on the user's shoulder.

The kit 200 may also include additional components, including, but not limited to, spare anchor stakes 130, a covering patch kit, and additional bag members. Additional bag members may be used to organize kit components within carrying bag 190. For example, a bag member may be dedicated and sized for stowing the anchor stakes 130, and another bag member may be dedicated and sized for stowing the components of the frame 70. Filled bag members are easily inserted into carrying bag 190 through opening 196.

The kit 200 may also include items not directly related to the portable ice fishing enclosure 10, but which are useful in the sport of ice fishing. These items may include, but are not limited to, at least one ice fishing rod and reel, at least one tip up, a hole-forming tool, and a heat source.

Method

The present invention also provides a method of assembling the portable ice fishing enclosure 10. One example of a method which may be used for assembling the portable shelter are as follows:

Step 1. Position the covering on the ground or ice surface 5 so that an exterior surface 63 of the ceiling faces upwardly, an interior surface 62 of the ceiling 24 confronts the ice surface 5, and so that the sidewalls 22 are situated below the ceiling in a collapsed manner.

Step 2. From the inside of the housing, secure one of the sub-frames 72 to the interior surface 62 of one sidewall 22 by inserting the distal end 166 of each pole 76 into a respective pocket 64 on the interior surface 62 of the sidewall 22, with the outer face 92 of the hub oriented facing outwardly, against the material of the sidewall.

Step 3. The hub is then pushed outwardly until it bows out past the corners of the sidewall 22, in a gently bowed configuration similar to an open, unfurled umbrella.

Step 4. Repeat steps 2 and 3 for each remaining sidewall 22 and also for the ceiling 24, until all respective sidewalls 22 and the ceiling each have a sub-frame 72 secured to an interior surface 62 thereof.

Step 5. (optional) Actuate the tensioning mechanism 160 of the tensioning strap 150 for any sidewall panels 22 or ceiling 24 having tensioning straps thereon, until the respective fabric panel is pulled taut across the sub-frame 72. The fabric is thereby made more wind-resistant.

Step 6. Arrange the skirt portions 50 over and parallel to the ice surface or other substrate 5, and each end 54 of the skirt portion 50 is arranged to lie in a layered, overlapping relationship with the end 54' of the skirt portion 50 of the adjacent sidewall 22' such that through hole 58 of an end 54 of the skirt portion 50 of one sidewall 22 overlies and is in vertical alignment with the through hole 58 of an end 54' of the skirt portion 50 of the adjacent sidewall 22' to form a vertically aligned through hole pair 66.

Step 7. For each vertically aligned through hole pair 66, insert an anchor stake 130 into the through hole 66 pair such that the tip 140 of the tapered, threaded lower end 138 contacts the ice surface 5.

Step 8. For each through hole pair 66, turn the handle 132 of the anchor stake 130 with downward pressure applied to the stake, so that the threads 142 of the lower end 138 draw the anchor stake 130 into the ice surface 5 until the flange 136 abuts the respective skirt end 54.

A similar method would be followed for the enclosure 210 of FIG. 13, except that the method of assembling the frame 350 would involve interconnecting the poles 354, 355 and the central connector 352, including inserting some of the appropriate pole ends into the integral sleeves 356, and concurrently slipping the poles 354, 355 through the fabric sleeves provided to hold the poles in place in the housing. Here again, the ends of the skirt portions would be placed in aligned overlapping configuration, and the anchor stakes would be inserted through the grommets and rotated to screw into, and rigidly anchor the corners of the housing to the substrate 5.

Although the presently contemplated embodiments of a portable enclosure for use in ice fishing have been described herein, the foregoing description is intended to illustrate, rather than to limit the invention. Those skilled in the art will recognize that various substitutions and modifications can be made, without departing from the invention. All such modifications, which are within the scope of the appended claims, are intended to be within the scope and spirit of the present invention.

What is claimed is:

1. A portable and collapsible shelter for placement on an outdoor substrate to protect a user from the environment, the portable shelter comprising:

a shell formed of flexible sheet material;

a frame structure for supporting the shell; and a plurality of anchor stakes for securing the shell to the substrate, wherein each of said anchor stakes has a threaded end with an arcuate helical tip;

wherein the shell comprises:

a plurality of interconnected sidewalls arranged lateral edge to lateral edge such that each of the plural sidewalls is joined to an adjacent sidewall at respective lateral edges;

and a skirt portion attached to a respective bottom edge of each sidewall of the plurality of sidewalls, wherein the skirt portion comprises an elongated strip of material which is wider than said sidewall, the skirt portion extending substantially continuously along the entire lower edge of the sidewall such that ends of the skirt portion extend beyond both lateral edges of said sidewall, each end of the skirt portion provided with a through hole formed therein, wherein the ends of each of the respective skirt portions are reinforced in an area thereof surrounding the respective through holes, using metal or plastic grommets, wherein the threaded end of each of the anchor stakes is dimensioned and configured to fit into and to be insertable through one of said grommets;

wherein each end of the skirt portion is adapted to be arranged in a layered, overlapping relationship with an end of a skirt portion of an adjacent sidewall, such that a through hole of a skirt portion of one sidewall overlies and is capable of placement in stacked vertical alignment with the through hole of a skirt portion of the adjacent sidewall, to form a vertically aligned through hole pair adapted to receive one of said anchor stakes therethrough;

and wherein the frame comprises a plurality of sub-frames, the number of sub-frames corresponding to the number of sidewalls plus one.

2. The portable shelter of claim 1, wherein each sub-frame of the frame structure comprises plural poles extending from a single central hub, and each sub-frame spaced apart from the remaining sub-frames.

3. The portable shelter of claim 2, wherein the shell comprises a ceiling panel attached to upper ends of said sidewalls, wherein a sub-frame is provided for each sidewall of said plural sidewalls, and wherein a sub-frame is provided for the ceiling panel, wherein each sidewall of said plural sidewalls and the ceiling panel are each provided with a plurality of pockets formed on an inner surface thereof, and wherein each sidewall of said plural sidewalls and the ceiling panel is adapted to support one sub-frame by receiving the distal end of a respective pole within a respective one of said plurality of pockets.

4. The portable shelter of claim 1, wherein each of the plurality of anchor stakes comprises:

a shank comprising:

an upper end, and a lower end which is tapered and which has screw threads formed on the outer surface thereof; the lower end terminating at a pointed tip that is oriented at an angle relative to the axis of the shank;

and wherein each anchor stake further comprises a flange extending radially outwardly from a medial portion of the shank, wherein the lower end of the shank is insertable through aligned ends of the skirt portions and into a substrate, such that a portion of the shell is held between the flange and the substrate.

5. A portable and collapsible shelter for placement on an outdoor substrate to protect a user from the environment, the portable shelter comprising:

a shell formed of flexible sheet material;

a frame structure for supporting the shell; and a plurality of anchor stakes for securing the shell to the substrate, wherein the shell comprises:

a plurality of interconnected sidewalls arranged lateral edge to lateral edge such that each of the plural sidewalls is joined to an adjacent sidewall at respective lateral edges; and a skirt portion attached to a respective bottom edge of each sidewall of the plurality of sidewalls, wherein the skirt portion comprises an elongated strip of material which is wider than said sidewall, the skirt portion extending substantially continuously along the entire lower edge of the sidewall such that ends of the skirt portion extend beyond both lateral edges of said sidewall, each end of the skirt portion provided with a through hole formed therein;

and wherein each end of the skirt portion is adapted to be arranged in a layered, overlapping relationship with an end of a skirt portion of an adjacent sidewall, such that a through hole of a skirt portion of one sidewall overlies and is capable of placement in stacked vertical alignment with the through hole of a skirt portion of the adjacent sidewall, to form a vertically aligned through hole pair adapted to receive one of said anchor stakes therethrough; wherein the frame comprises a plurality of sub-frames, and wherein each sub-frame comprises plural poles extending from a central hub, the central hub comprising a cylindrical body, the central hub comprising a substantially flat inner surface, a molded outer surface, and an arcuate edge surface extending between the outer surface and the inner surface, the central hub having plural shaped through holes extending from the outer surface to the inner surface, the plural shaped through holes positioned so as to be equidistantly spaced and so as to surround a longitudinal axis of the central hub, the central hub further having plural radial channels formed in the inner surface thereof, each plural radial channel extending from the edge surface and intersecting with a respective shaped through hole, each pole of the plural poles comprising an elongate rod having a hub end, and a distal end opposed to the hub end, the hub end of each pole comprising at least one key member, the at least one key member shaped to cooperatively interact with one of said plural shaped channels of the central hub to maintain the hub end of the pole within the central hub, each pole of the plural poles pivotally positioned within the central hub such that the hub end thereof is situated in one of said plural radial channels, and such that a terminus of the hub end resides within the corresponding one of said plural shaped channels, each of said sub-frames further comprising a cover member attached to said hub.

6. A portable and collapsible shelter for placement on an outdoor substrate to protect a user from the environment, the portable shelter comprising:

a shell formed of flexible sheet material;

a frame structure for supporting the shell; and a plurality of anchor stakes for securing the shell to the substrate, wherein the shell comprises:

a plurality of interconnected sidewalls arranged lateral edge to lateral edge such that each of the plural sidewalls is joined to an adjacent sidewall at respective lateral edges; and a skirt portion attached to a respective bottom edge of each sidewall of the plurality of sidewalls, wherein the skirt portion comprises an elongated strip of material which is wider than said sidewall, the skirt portion extending substantially continuously along the entire lower edge of the sidewall such that ends of the skirt portion extend beyond both lateral edges of said sidewall, each end of the skirt portion provided with a through hole formed therein;

and wherein each end of the skirt portion is adapted to be arranged in a layered, overlapping relationship with an end of a skirt portion of an adjacent sidewall, such that a through hole of a skirt portion of one sidewall overlies and is capable of placement in stacked vertical alignment with the through hole of a skirt portion of the adjacent sidewall, to form a vertically aligned through hole pair adapted to receive one of said anchor stakes therethrough; wherein a tensioning member is provided for at least one of said plural sidewalls such that it extends in an area disposed between opposed edges thereof, the tensioning member comprising a fixed length strap, an adjustable length strap, and a tensioning assembly joining the fixed length strap to the adjustable length strap.

7. A portable shelter for placement on an outdoor substrate to provide protection from the environment, the portable shelter comprising a frame, a flexible shell supported by the frame, and a plurality of anchor stakes, the portable shelter configured to be attachable to the substrate using said anchor stakes, the flexible shell having a lower end and a closed upper end, and comprising a plurality of interconnected sidewalls, and a skirt portion attached to a lower portion of each of said sidewalls, each skirt portion comprising an elongate flexible band having a first end, a second end, and a body portion, the body portion of the skirt portion extending substantially continuously along the lower edge of the associated sidewall, each skirt portion having a width such that both the first end and the second end extend beyond the lower edge of the sidewall, and each first end and second end of each skirt portion having a through hole formed therein and a reinforcement surrounding said through hole, wherein said reinforcement comprises a metal or plastic grommet;

wherein the frame comprises a plurality of sub-frames, the number of sub-frames corresponding to the number of sidewalls plus one;

and wherein when the portable shelter is attached to a supportive substrate and in a fully assembled configuration thereof, each respective sidewall of the plural sidewalls extends upwardly from the substrate, and the skirt portion of each respective sidewall of the plural sidewalls overlies the substrate, with a first end of the skirt portion of one side wall overlying a second end of the skirt portion of an adjacent sidewall so that that the through holes of the respective first and second ends are in alignment, and such that one of the threaded anchor stakes is insertable through the aligned through holes and into the substrate.

8. The portable shelter of claim 7, wherein each of said anchor stakes comprises a shank, the shank having an upper end formed into a handle, the shank having a lower end which tapers to an arcuate helical tip, the lower end of the shank being provided with screw threads on an outer surface thereof, the anchor stake further comprising a medial flange extending radially outwardly from a medial portion of the shank.

9. The portable shelter of claim 7, wherein each sub-frame comprises plural poles extending radially outwardly from a central hub, each sub-frame spaced apart and separate from the remaining sub-frames.

10. A portable and collapsible shelter for placement on an outdoor substrate to protect a user from the environment, the portable shelter comprising:

a shell formed of flexible sheet material;

a frame structure for supporting the shell; and a plurality of anchor stakes for securing the shell to the substrate;

wherein the shell comprises:

a plurality of interconnected sidewalls; and a skirt portion attached to a respective bottom edge of each sidewall of the plurality of sidewalls, wherein the skirt portion comprises an elongated strip of material which is wider than said sidewall, the skirt portion extending substantially continuously along the entire lower edge of the sidewall such that ends of the skirt portion extend beyond both lateral edges of said sidewall, each end of the skirt portion provided with a through hole formed therein, wherein the ends of each of the respective skirt portions are reinforced in an area thereof surrounding the respective through holes, using metal or plastic grommets;

wherein the frame structure comprises a plurality of sub-frames, and wherein the number of sub-frames corresponds to the number of sidewalls plus one;

and wherein each end of the skirt portion is adapted to be arranged in a layered, overlapping relationship with an end of a skirt portion of an adjacent sidewall, such that a through hole of a skirt portion of one sidewall overlies and is capable of placement in stacked vertical alignment with the through hole of a skirt portion of the adjacent sidewall, to form a vertically aligned through hole pair adapted to receive one of said anchor stakes therethrough.

* * * * *

UNITED STATES PATENT AND TRADEMARK OFFICE

CERTIFICATE OF CORRECTION

PATENT NO. : 7,320,332 B2
APPLICATION NO. : 11/060079
DATED : January 22, 2008
INVENTOR(S) : Reis It is certified that error appears in the above-identified patent and that said Letters Patent is hereby corrected as shown below:

On Title page:
After Item "(74) *Attorney, Agent, or Firm*", between "Associates" and "P.C." insert a comma.

Column 1:
Line 27, change "lodge tents to hunting blinds to ice fishing" to --lodge tents, to hunting blinds, to ice fishing--.
Line 33, change "unwieldy wooden framed" to --unwieldy wooden-framed--.
Line 58, change "structure in which includes" to --structure which includes--.

Column 2:
Line 50, change "durable, lightweight flexible covering" to --durable, lightweight, flexible covering--.

Column 3:
Line 21, change "sidewalls adjacent the ice" to --sidewalls adjacent to the ice--.

Column 5:
Line 4, change "of the of the" to --of the--.

Column 6:
Line 17, change "egress from the enclosure" to --egress from, the enclosure--.
Line 32, change "of skirt portion" to --of the skirt portion--.
Line 63, change "overlies and is in vertical alignment with" to --overlies, and is in vertical alignment with,--.

Column 7:
Line 55, change "provide for each hub" to --provided for each hub--.

Column 8:
Line 43, change "freestanding, three dimensional" to --freestanding, three-dimensional--.
Line 48, change "Thus one or more" to --Thus, one or more--.

Column 9:
Line 9, change "is described is illustrated" to --as described is illustrated--.
Line 47, change "secured. Thus" to --secured. Thus,-- (i.e., add a comma after "Thus").

UNITED STATES PATENT AND TRADEMARK OFFICE

CERTIFICATE OF CORRECTION

PATENT NO. : 7,320,332 B2
APPLICATION NO. : 11/060079
DATED : January 22, 2008
INVENTOR(S) : Reis It is certified that error appears in the above-identified patent and that said Letters Patent is hereby corrected as shown below:

Column 11:
Line 50, change "egress from the enclosure" to --egress from, the enclosure--.

Column 12:
Line 36, change "poles 354, 355 and" to --poles 354, 355-- (i.e., delete "and" at the end of line 36).
Line 63, change "and adapted or grasping" to --and adapted for grasping--.

Column 13:
Line 16, change "shelter are as follows:" to --shelter is as follows:--.
Line 51, change "through hole 66 pair" to --through hole pair 66--.

Column 17:
Line 19, change "so that that the" to --so that the--.

Signed and Sealed this

Twenty-seventh Day of January, 2009

JOHN DOLL
*Acting Director of the United States Patent and Trademark Office*